US010774409B2

(12) United States Patent
Uggowitzer et al.

(10) Patent No.: US 10,774,409 B2
(45) Date of Patent: Sep. 15, 2020

(54) AGE-HARDENABLE ALUMINUM ALLOY AND METHOD FOR IMPROVING THE ABILITY OF A SEMI-FINISHED OR FINISHED PRODUCT TO AGE ARTIFICIALLY

(71) Applicant: AMAG ROLLING GMBH, Braunau am Inn—Ranshofen (AT)

(72) Inventors: Peter J. Uggowitzer, Ottenbach (CH); Stefan Pogatscher, Gai (AT); Helmut Antrekowitsch, Leoben (AT); Marion Werinos, Ebersdorf (AT); Thomas Ebner, Braunau am Inn (AT); Carsten Melzer, Weng/Ueberackern (AT)

(73) Assignee: AMAG ROLLING GMBH, Braunau am Inn—Ranshofen (AT)

( * ) Notice: Subject to any disclaimer, the term of this patent is extended or adjusted under 35 U.S.C. 154(b) by 0 days.

(21) Appl. No.: 16/242,204

(22) Filed: Jan. 8, 2019

(65) Prior Publication Data

US 2019/0136355 A1 May 9, 2019

Related U.S. Application Data

(62) Division of application No. 14/380,540, filed as application No. PCT/EP2013/053643 on Feb. 22, 2013, now Pat. No. 10,214,802.

(30) Foreign Application Priority Data

Feb. 23, 2012 (EP) ..... 12156623

(51) Int. Cl.

| | |
|---|---|
| ***C22F 1/053*** | (2006.01) |
| ***C22F 1/04*** | (2006.01) |
| ***C22F 1/047*** | (2006.01) |
| ***C22F 1/05*** | (2006.01) |
| ***C22C 21/04*** | (2006.01) |
| ***C22C 21/08*** | (2006.01) |
| ***C22C 21/10*** | (2006.01) |

(52) U.S. Cl.

CPC ..... *C22F 1/053* (2013.01); *C22C 21/04* (2013.01); *C22C 21/08* (2013.01); *C22C 21/10* (2013.01); *C22F 1/04* (2013.01); *C22F 1/047* (2013.01); *C22F 1/05* (2013.01); *C21D 2211/004* (2013.01)

(58) Field of Classification Search

CPC .. C22F 1/043; C22F 1/047; C22F 1/05; C22F 1/053; C22C 21/04; C22C 21/08; C22C 21/10; C21D 2211/004

See application file for complete search history.

(56) References Cited

U.S. PATENT DOCUMENTS 3,337,377 A * 8/1967 Bonmarin ..... C22C 21/08 148/702

5,580,402 A 12/1996 Fujita et al.

FOREIGN PATENT DOCUMENTS

| | | | |
|---|---|---|---|
| DE | 693 11 089 T2 | | 1/1998 |
| EP | 0 613 959 A1 | | 9/1994 |
| JP | 110102178 A | | 4/1998 |
| JP | 2011-202284 | * | 10/2011 |
| JP | 2011-202284 A | | 10/2011 |

OTHER PUBLICATIONS

International Search Report of PCT/EP2013/053643, dated Jun. 6, 2013.

Stulikova et al: "Influence of composition on natural ageing of Al—Mg—Si alloys", Kovove Materialy—Metal Materials, vol. 45, No. 2, Jan. 1, 2007 (Jan. 1, 2007), pp. 85-90, XP008153273, ISSN: 0023-432X.

Pogatscher S et al: "Mechanisms controlling the artificial aging of Al—Mg—Si Alloys", ACTA Materialia, Elsevier, Oxford, GB, vol. 59, No. 9, Feb. 3, 2011 (Feb. 3, 2011), pp. 3352-3363, XP028195509, ISSN: 1359-6454.

Wolverton et al: "Solute-vacancy binding in aluminum", ACTA Materialia, Elsevier, Oxford, GB, vol. 55, No. 17, Sep. 21, 2007 (Sep. 21, 2007), pp. 5867-5872, XP022264876, ISSN: 1359-6454.

Hatch J E Ed—Hatch J E: "Aluminium, Properties and Physical Metallurgy, passage", Jan. 1, 1987 (Jan. 1, 1987), Aluminum. Properties and Physical Metallurgy, Ohio, American Society for Metals, US, pp. 224-241, XP002441131.

Friedrich Ostermann: Anwendungstechnik Aluminium [Aluminum application technology], 2nd revised and updated edition, Springer Berlin Heidelberg New York, p. 152 to 153, ISBN 978-3-540-71196-4.

Benedikt Klobes: Strukturelle Umordnungen in Aluminiumlegierungen: Ein komplementarer Ansatz aus der Perspektive von Leerstellen und Fremdatomen [Structural rearrangements in aluminum alloys: A complementary approach from the perspective of empty spaces and foreign atoms], Bonn 2010, publication year 2010.

Wikipedia entry for "Solid solution" downloaded from https://en.wikipedia.org/wiki/Solid_solution on Oct. 3, 2018.

Wikipedia entry for "Quenching" downloaded from https://en.wikipedia.org/wiki/Quenching on Oct. 3, 2018.

Pogatscher et al., "Optimization of the heat treatment of aluminum materials of the 6xxx family", Laboratory for metal physics and technology,Conference Paper Nov. 2014, 4 pages.

* cited by examiner

*Primary Examiner* — C Melissa Koslow
(74) *Attorney, Agent, or Firm* — Collard & Roe, P.C.

(57) ABSTRACT

An age-hardenable aluminum alloy on the basis of Al—Mg—Si, Al—Zn, Al—Zn—Mg or Al—Si—Mgv has precipitates caused by natural aging. The aluminum alloy has at least one alloy element, in addition to its main alloy element or in addition to its main alloy elements, which can be correlated with quenched-in empty spaces of the aluminum alloy, particularly reducing their mobility in the crystal lattice, at such a content less than 500, particularly less than 200 atomic ppm, that the aluminum alloy forms empty spaces essentially not correlated with these precipitates, in order to reduce the negative effect of natural aging of the aluminum alloy on its further artificial aging, by mobilization of these non-correlated empty spaces.

9 Claims, 3 Drawing Sheets

AGE-HARDENABLE ALUMINUM ALLOY AND METHOD FOR IMPROVING THE ABILITY OF A SEMI-FINISHED OR FINISHED PRODUCT TO AGE ARTIFICIALLY

CROSS REFERENCE TO RELATED APPLICATIONS

This application is a divisional of and Applicant claims priority under 35 U.S.C. §§ 120 and 121 of U.S. application Ser. No. 14/380,540 filed on Aug. 22, 2014, now U.S. Pat. No. 10,214,802, issued Feb. 26, 2019, which application is a national stage application under 35 U.S.C. § 371 of PCT Application No. PCT/EP2013/053643 filed on Feb. 22, 2013, which claims priority under 35 U.S.C. § 119 from European Application No. 12156623.6 filed on Feb. 23, 2012, the disclosures of each of which are hereby incorporated by reference. A certified copy of priority European Patent Application No. 12156623.6 is contained in parent U.S. application Ser. No. 14/380,540. The International Application under PCT article 21(2) was not published in English.

BACKGROUND OF THE INVENTION

1. Field of the Invention

The invention relates to an aluminum alloy and to a method for improving the ability of a semi-finished product or end product to age artificially, having an age-hardenable aluminum alloy on the basis of Al—Mg—Si, Al—Zn, Al—Zn—Mg or Al—Si—Mg, in which the aluminum alloy is transformed to a state of solid solution, particularly by means of solution annealing, is quenched and subsequently forms precipitates by means of natural aging, wherein the method comprises at least one measure for reducing a negative effect of natural aging of the aluminum alloy on its artificial aging.

2. Description of the Related Art

The most varied measure for temperature treatment of the aluminum alloy are known for reducing the negative effect of natural aging on artificial aging to be carried out later, in the case of age-hardenable aluminum alloys on the basis of Al—Mg—Si, for example of the 6xxx series. Included among these are, for example, step-by-step quenching, stabilization annealing, or also recovery annealing (see Friedrich Ostermann: Anwendungstechnik Aluminium [Aluminum application technology], $2^{nd}$ revised and updated edition, Springer Berlin Heidelberg N.Y., page 152 to 153, ISBN 978-3-540-71196-4). Such measures for improving the ability to age artificially cause comparatively great method effort, and furthermore they are relatively cost-intensive and, under some circumstances, also problematical in terms of production technology, thereby making it difficult to achieve reproducibility and uniformity of the properties of the product. Here, however, uniform properties of the aluminum alloy are particularly required—they are not allowed to change as the result of storage—at least not limited storage—or as the result of the natural aging of the aluminum alloy connected with it.

Furthermore, it is known for an AA6013 aluminum alloy (see Benedikt Klobes: Strukturelle Umordnungen in Aluminiumlegierungen: Ein komplementärer Ansatz aus der Perspektive von Leerstellen and Fremdatomen [Structural rearrangements in aluminum alloys: A complementary approach from the perspective of empty spaces and foreign atoms], Bonn 2010, publication year 2010, pages 104 and 105) to attribute a negative effect of natural aging on subsequent artificial aging to the fact that the foreign atoms required for the formation of β" are only made available by means of the dissolution of precipitates. These precipitates are all correlated with empty spaces, or the empty spaces are located in the region of the precipitates. In contrast to the AA6013 aluminum alloy, larger precipitates and smaller agglomerates, from which foreign atoms for β" can be obtained, are found at the beginning of artificial aging in other 6xxx alloys that do not have a negative effect of natural aging on their artificial aging. The influence of natural aging on the artificial aging method of Al—Mg—Si alloys is primarily understood to be an effect of the alloy content here.

For age-hardenable aluminum alloys on the basis of Al—Cu, for example for 2xxx alloys, it is known (see Benedikt Klobes: Strukturelle Umordnungen in Aluminiumlegierungen: Ein komplementärer Ansatz aus der Perspektive von Leerstellen and Fremdatomen [Structural rearrangements in aluminum alloys: A complementary approach from the perspective of empty spaces and foreign atoms], Bonn 2010, publication year 2010, pages 79 and 81) to add gold (Au) to the 2xxx aluminum alloy in order to thereby reduce its natural aging, in that gold captures these empty spaces. The same effect is also known for an addition of tin (Sn). Thereby a method for natural aging can be optimized; however, it is known that 2xxx alloys do not demonstrate any negative effects of natural aging on subsequent artificial aging.

DE69311089T2 discloses an age-hardenable Al—Cu—Mg aluminum alloy that contains Si, for press-formable sheets. In order to reduce disadvantageous natural aging or a secular change in strength before press-forming of the sheet, DE69311089T2 or EP0613959A1 proposes, among other things, the use of tin (Sn), indium (In), and cadmium (Cd) alloy elements. These elements are specifically supposed to bind to empty spaces that have been quenched in, in order to reduce the number of empty spaces that serve as GPB-zone-forming locations of the Al—Cu—Mg compound. Furthermore, the addition of silicon is described, in order to also achieve an improvement in the hardenability of the aluminum alloy, aside from the delay in natural aging. DE69311089T2 does not concern itself with the disadvantageous effects of natural aging on subsequent artificial aging of an aluminum alloy.

Furthermore, it is known for aluminum alloys on the basis of Al—Mg—Si (see Stulikova et al., "Influence of composition on natural ageing of Al—Mg—Si alloys," Kovove Material—Metal Materials, Vol. 45, No. 2, Jan. 1, 2007, pages 85-90, XP8153273, ISSN: 0023-432X) that Sn binds empty spaces and delays natural aging. For aluminum alloys of the 6xxx series 0.522 and higher wt.-% of Sn are proposed. In general, it is furthermore mentioned that natural aging has a negative influence on subsequent artificial aging, but this is also sufficiently known from other literature references.

SUMMARY OF THE INVENTION

It is therefore the task of the invention to improve a method of the type described initially, in such a manner that as a result, even if storage of the semi-finished product or end product, demonstrating an age-hardenable aluminum alloy is accepted, the ability of the product to age artificially does not suffer from this.

The invention accomplishes the stated task, with regard to the method, in that a measure for reducing the negative effect comprises adding at least one alloy element, which can enter into correlation with empty spaces that have been quenched in, to the aluminum alloy, at a proportion of less than 500, particularly less than 200 atomic ppm in the aluminum alloy, thereby increasing the number of empty spaces that are not correlated with precipitates at the beginning of artificial aging, in order to reduce the negative effect of natural aging of the aluminum alloy on its further artificial aging, by means of mobilization of these non-correlated empty spaces.

If a measure for reducing the negative effect comprises adding at least one alloy element, which can enter and particularly enters into correlation with empty spaces that have been quenched in, to the aluminum alloy, at a proportion of less than 500 atomic ppm in the aluminum alloy, thereby increasing the number of non-correlated empty spaces at the beginning of artificial aging with precipitates, an aluminum alloy can be created that allows mobilization of empty spaces in the crystal lattice that is not impaired by cold precipitates, or at least impaired to a lesser degree. This can be utilized, according to the invention, to reduce the negative effect of natural aging of the aluminum alloy on its further artificial aging, in that these non-correlated empty spaces are mobilized.

Supplementally, it can be noted that empty spaces not correlated with precipitates can be understood to mean those empty spaces that are not bonded to, absorbed by and/or influenced in some other way, in terms of their mobility and/or mobilizability, by precipitates, for example. In contrast to the state of the art, it is therefore no longer required to use also those empty spaces whose mobility is significantly hindered during artificial aging, due to a correlation with cold precipitates. Therefore the negative effects of the cold precipitates acting as prisons for empty spaces can be reduced, or even possibly prevented entirely, at least at the beginning of artificial aging, thereby making it possible to ensure unimpaired artificial aging, with regard to the ability to age artificially and also artificial aging kinetics, despite interim storage of the aluminum alloy. The ability to age artificially, known for aluminum alloys on the basis of Al—Mg—Si, Al—Zn, Al—Zn—Mg or Al—Si—Mg, particularly of 6xxx alloys, can therefore be achieved even if artificial aging is not started immediately after quenching of the aluminum alloy. Furthermore, adding the alloy element or alloy elements that is/are active for the empty spaces can be accomplished and also handled in simple manner, in terms of process technology, in that they are added to the solid solution of the aluminum alloy, for example. It is therefore possible to do without complicated heat treatment methods as they are known from the state of the art, and ultimately this can lead to a significant cost advantage. In general, it should be mentioned that a semi-finished product or end product can be understood to mean sheets, plates, cast parts, etc. Furthermore, by means of this method, advantages also occur with regard to reduced quenching sensitivity to the solution annealing temperature, an improvement in the mechanical properties (for example fracture toughness), improved corrosion resistance, and possible lengthening of the storage time at room temperature. The content of this alloy element or these alloy elements that is/are active for the empty spaces should preferably be restricted to a low measure, in order to thereby not impair the re-mobilizability of the empty spaces due to other precipitate structures that might form. Thus, for example, an addition of less than 200 atomic ppm was already found to be sufficient.

In general and/or for the sake of completeness, it should be mentioned that

- the aluminum alloy on the basis of Al—Mg—Si can be a kneaded alloy of the 6xxx series, in other words with magnesium and silicon as the main alloy elements;
- an Al—Mg—Si(Cu) kneaded or cast alloy can also be considered an aluminum alloy on the basis of Al—Mg—Si;
- the aluminum alloy on the basis of Al—Si—Mg can be a cast alloy of the 4xxx alloy series (EN AC-4xxx);
- an Al—Si—Mg(Cu) kneaded or cast alloy can also be considered an aluminum alloy on the basis of Al—Si—Mg;
- the aluminum alloy on the basis of Al—Zn or Al—Zn—Mg can be a kneaded alloy of the 7xxx alloy series, in other words with zinc as the main alloy element, or also a cast alloy of the 7xxx series (EN-AC-7xxx), in other words with zinc as the main alloy element;
- an Al—Zn—Mg(Cu) kneaded or cast alloy can also be considered an aluminum alloy on the basis of Al—Zn—Mg;
- an aluminum alloy on the basis of Al—Mg—Si, Al—Zn, Al—Zn—Mg or Al—Si—Mg can certainly be used for a kneaded and/or cast alloy, whereby in this connection, composite materials that are reinforced with particles or fiber materials are not excluded.

If the number of empty spaces not correlated with Mg/Si co-clusters is increased in aluminum alloys on the basis of Al—Mg—Si or Al—Si—Mg, the significant restriction in mobility of the empty spaces in the crystal lattice that these clusters can exert on the empty spaces can be reduced. In addition, according to the invention, natural aging of the aluminum alloy can also be hindered, and this can be utilized, in particularly advantageous manner, in an aluminum alloy of the 6xxx kneaded alloy series or the 4xxx cast alloy series.

Particularly advantageous method conditions can occur if the added alloy element makes up from 100 to less than 400 atomic ppm in the aluminum alloy. An addition of more than 20 to less than 200 atomic ppm was already found to be sufficient, for example.

If the added alloy elements make up a total proportion of less than 500, particularly less than 400 atomic ppm in the aluminum alloy, limiting of the content of alloy elements or trace elements that can be handled relatively easily can be predetermined, and thereby the reproducibility of the method can be increased.

Sn, Cd, Sb and/or In can distinguish themselves for the method for improving the ability of a semi-finished product or end product to age artificially, as an additional alloy element or as additional alloy elements. However, other alloy elements are certainly possible, which enter into correlation with empty spaces during interim storage of the semi-finished product or end product, and release these empty spaces during artificial aging, and can contribute to their rapid re-mobilizability.

If the aluminum alloy on the basis of Al—Mg—Si or Al—Si—Mg is transformed to a state of solid solution at a minimum temperature of 530 degrees Celsius, particularly solution-annealed at this temperature, the solubility of the added alloy element, particularly Sn, can be clearly improved. In this way, the security of artificial aging not impaired with regard to ability to age artificially and also artificial aging kinetics can be increased.

It can prove to be particularly advantageous if at least one alloy element that can enter, particularly enters into correlation with quenched-in empty spaces of an aluminum alloy, particularly Sn, Cd, Sb and/or In, is used as an additive having a content in the aluminum alloy of less than 500, particularly less than 200 atomic ppm, to an age-hardenable aluminum alloy, particularly on the basis of Al—Mg—Si, Al—Zn, Al—Zn—Mg or Al—Si—Mg, to increase the number of empty spaces not correlated with precipitates at the beginning of artificial aging, in order to reduce the negative effect of natural aging of the aluminum alloy on its further artificial aging, by means of mobilization of these non-correlated empty spaces. In particular, in the case of these 6xxx or 7xxx aluminum alloys, the use of Sn, Cd, Sb and/or In as an additive could be advantageous. The combination of alloy elements achieved by such use demonstrates not only effects of a reduction in natural aging, for example caused by interim storage, but also properties that are surprisingly advantageous for artificial aging, with regard to the ability to age artificially and the artificial aging kinetics, particularly if the mobility of the empty spaces in the crystal lattice is thereby reduced. As compared with 6xxx and/or 7xxx kneaded aluminum alloys or 4xxx, 7xxx cast aluminum alloys without the content of the alloy element according to the invention or the alloy elements according to the invention, it was possible to find a clear increase in the hardness that could be achieved, combined with a significant reduction in the artificial aging time, which can be essentially attributed to easier re-mobilizability of empty spaces in the crystal lattice. Particularly on the basis of the low concentration, almost corresponding to that of a trace element, negligible influences on the structural properties of the aluminum alloy treated with this can be expected. Known recognitions—particularly with regard to the material properties—concerning this aluminum alloy can therefore be used further without any restrictions, and this can particularly distinguish the invention.

Furthermore, it can prove to be advantageous if at least one alloy element that can enter into correlation with quenched-in empty spaces of an aluminum alloy, particularly can reduce their mobility in the crystal lattice, particularly Sn, Cd, Sb and/or In, is used as an additive to an age-hardenable aluminum alloy, to reduce the annihilation of empty spaces during artificial aging. This can be particularly advantageous for aluminum alloys on the basis of Al—Mg—Si, Al—Zn, Al—Zn—Mg or Al—Si—Mg. As a result, the dwell time of the empty spaces in the crystal lattice can be clearly increased, and nevertheless, such great mobility can be ensured that rapid artificial aging of the aluminum alloy takes place. Annihilation of the empty spaces by means of destruction, for example in sinks and/or at phase boundaries, can thereby be clearly reduced, even if comparatively high temperatures prevail during artificial aging, which can be the case when a temperature range from 200 to 300 degrees Celsius is used, at least part of the time.

Surprisingly, it can also be made possible in this way that artificial aging of the aluminum alloy—specifically even without prior natural aging—demonstrates improved method parameters, in that an advantageous response of the aluminum alloy during the course of artificial aging and also elevated strength values were found, for example.

If the number of empty spaces not correlated with Mg/Si co-clusters is increased at the beginning of artificial aging, in the case of the aluminum alloy on the basis of Al—Mg—Si or Al—Si—Mg, the result can be achieved that the Mg/Si co-clusters that act as prisons for the empty spaces no longer can exert any negative influence on the ability of the aluminum alloy to age artificially. Thereby temporary natural aging also can no longer make the seed formation of the β" phase difficult. This can particularly be utilized for 6xxx kneaded alloys, which demonstrate a negative effect during artificial aging due to prior natural aging. This technical effect can also be utilized for cast alloys, particularly in the case of a 4xxx cast aluminum alloy.

The content of the added alloy element or of the added alloy elements can be further refined in that the amount of the alloy element used in the aluminum alloy has a content of 10, particularly more than 20, to less than 400, particularly less than 200 atomic ppm.

Furthermore, an upper limit of the added content of multiple alloy elements that are active for the empty spaces can stand out, in that the alloy elements make up a total proportion of less than 500, particularly less than 400 atomic ppm in the aluminum alloy.

The invention has furthermore set itself the task of improving an age-hardenable aluminum alloy on the basis of Al—Mg—Si, Al—Zn, Al—Zn—Mg or Al—Si—Mg in such a manner that this aluminum alloy does not require any special handling before final artificial aging, and thereby is also cost-advantageous, among other things. Furthermore, the aluminum alloy is supposed to be able to meet various standards in terms of its material composition.

The invention accomplished the stated task, with regard to the aluminum alloy, in that the aluminum alloy has at least one alloy element, in addition to its main alloy element or in addition to its main alloy elements, which can be correlated with quenched-in empty spaces of the aluminum alloy, particularly reducing their mobility in the crystal lattice, at such a content less than 500, particularly less than 200 atomic ppm, that the aluminum alloy forms empty spaces essentially not correlated with precipitates, in order to reduce the negative effect of natural aging of the aluminum alloy on its further artificial aging, by means of mobilization of these non-correlated empty spaces.

If the aluminum alloy has at least one alloy element, in addition to its main alloy element or in addition to its main alloy elements, which can be correlated with quenched-in empty spaces of the aluminum alloy, particularly reducing their mobility in the crystal lattice, having such a content less than 500, particularly less than 200 atomic ppm, that the aluminum alloy forms empty spaces essentially not correlated with precipitates, this aluminum alloy can at first be improved to be more resistant to undesirable natural aging or with regard to demands on its storage stability. Semi-finished products or end products of such an aluminum alloy can thereby experience an increase in their storage time at room temperature (RT). If, however, in addition this alloy also particularly responds to artificial aging, in that a negative effect of natural aging of the aluminum alloy on its artificial aging is reduced by means of mobilization of these non-correlated empty spaces, the mechanical properties, particularly the hardness, can also be improved, and improved corrosion resistance for semi-finished products or end products having such an aluminum alloy can be created. Sheets, plates, cast parts, etc., can be subsumed under semi-finished products or end products. The aluminum alloy according to the invention therefore does not require any special handling and/or any special method effort before final artificial aging, and is nevertheless cost-advantageous in its production. Furthermore, the concentration of the additional alloy elements lies on the order of trace elements, thereby making the influence on the crystal lattice of the aluminum alloy negligible. Standardized aluminum alloys can therefore be adhered to.

If an aluminum alloy on the basis of Al—Mg—Si or Al—Si—Mg has empty spaces essentially not correlated with Mg—Si co-clusters, the negative effect of natural aging can be reduced.

The alloy can be particularly suitable for artificial aging if it has Sn, Cd, Sb and/or In as an alloy element or as alloy elements.

For example, the alloy element in the aluminum alloy can have a content of 10, particularly more than 20, to less than 400, particularly less than 200 atomic ppm.

Furthermore, it can be predetermined as an upper limit of the alloy elements active for the empty spaces that the alloy elements have a total content of less than 500, particularly less than 400 atomic ppm in the aluminum alloy.

Particularly, however, an age-hardenable aluminum alloy of the 6xxx or 7xxx series, particularly AA6016, AA6061 or AA6082, which aluminum alloy contains Sn, Cd, Sb and/or In individually from 10, particularly more than 30, to less than 400, particularly 200 atomic ppm, and in total has at most 400 atomic ppm, and furthermore also contains production-related contaminants, individually at most 0.05 wt.-% and in total at most 0.4 wt.-%, can distinguish itself for achieving the technical effects according to the invention.

Such an aluminum alloy can particularly find use for a semi-finished product or end product, for example for sheets, plates, profiles, cast parts, components, structural elements (such as construction profiles), building blocks, etc.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
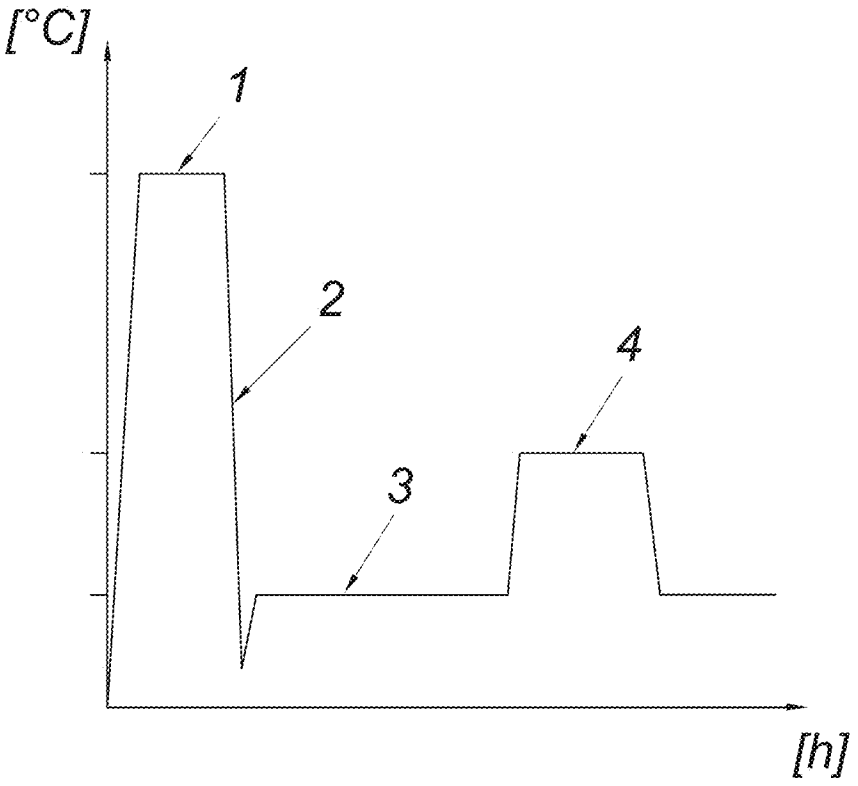
FIG. 1 shows a heat treatment of a 6xxx aluminum alloy.

According to FIG. 1, a conventional thermal treatment method for forming precipitates in an aluminum alloy is shown as an example. The aluminum alloy is first brought into a state of solid solution. For this purpose, solution annealing 1 at a high temperature is carried out in the phase territory of the homogeneous mixed crystal, as solution treatment. Afterward, rapid cooling takes place, using quenching 2 of the aluminum alloy, thereby causing the mixed crystal and the thermal empty spaces to be frozen or quenched in. The precipitation sequence, in other words the formation of precipitates in the aluminum alloy, begins by means of natural aging 3, for example natural aging brought about by cold storage at room temperature. After cold storage 3, the aluminum alloy is subjected to artificial aging 4, for example artificial aging brought about by hot storage. The thermal treatment method or precipitation hardening shown according to FIG. 1 does not comprise any measures for reducing a negative effect of natural aging 3 of the aluminum alloy on its artificial aging 4.

Figure 3:
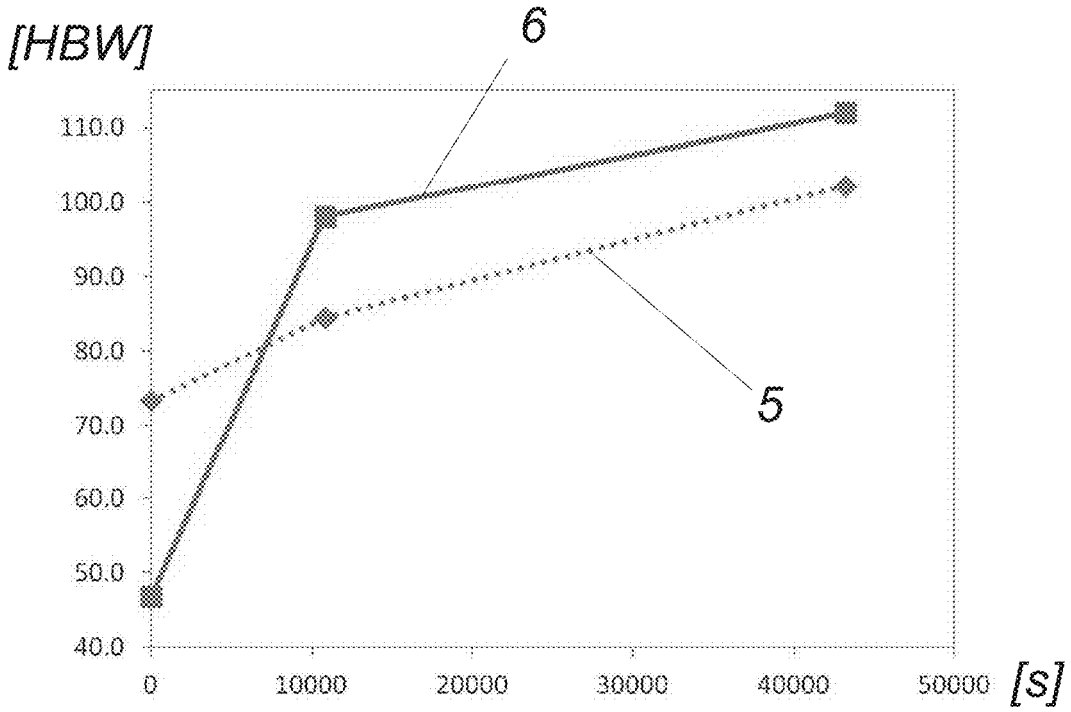
FIG. 3 is a representation concerning hardness changes brought about by artificial aging, which follow the natural aging according to FIG. 2.

According to FIG. 3, it can therefore be recognized that the hardness that can be reached by means of artificial aging, using hot storage at 170 degrees Celsius, of an AA6061 alloy 5 on the basis of Al—Mg—Si shown here, in relation to the artificial aging time, increases in relatively flat manner, as is shown in connection with hardness tests according to Brinell HBW 2.5/62.5. If one compares these data with a heat treatment of the same AA6061 alloy 5, in which natural aging was avoided and instead, quenching 2 was immediately followed by artificial aging 4, which is not shown in FIG. 3, a delay in the artificial aging kinetics and thereby a reduction in the maximal ability of the alloy 5 to age artificially occurs. A negative effect of natural aging 3 of the aluminum alloy 5 on its artificial aging 4 now has to be accepted.

According to the invention, this is generally avoided in that at least one alloy element that enters into correlation with quenched-in empty spaces is added to the solid solution. This particular alloy element—or a combination of them—increases the number of empty spaces not correlated with precipitates at the beginning of artificial aging, which are quickly mobilized during artificial aging and thereby reduces the negative effect of natural aging 3 of the aluminum alloy on the artificial aging 4.

Sn, Cd, Sb and/or In are possible as an additional alloy element or as additional alloy elements for this purpose.

In an aluminum alloy on the basis of Al—Mg—Si or Al—Si—Mg, advantages in terms of process technology in the solubility of these alloy elements, particularly of Sn, were furthermore shown if this aluminum alloy was transformed to a state of solid solution at a minimum temperature of 530 degrees Celsius, particularly solution-annealed at this temperature. The negative effect of natural aging on subsequent artificial aging is repressed even further as a result.

The effect of one of these trace elements that are active for the empty spaces, namely tin (Sn), as an addition to an AA 6061 alloy, is shown in FIG. 3 using the line 6. As compared with the AA 6061 alloy 5 without Sn, a clear improvement of the artificial aging using hot storage at 170 degrees Celsius can be seen, which is shown in connection with hardness tests according to Brinell HBW 2.5/62.5. The negative effect of the natural aging 3 of the aluminum alloy 6 on its artificial aging 4 is therefore less, if not completely absent. Similar results were also found for an AA6016 or AA6082.

Figure 2:
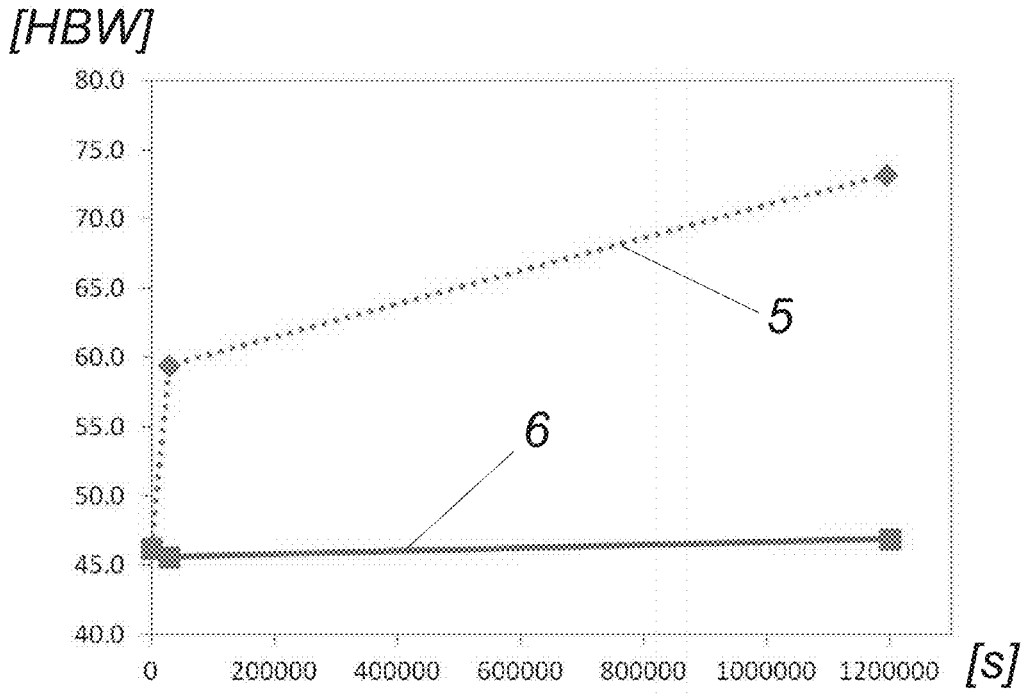
FIG. 2 is a representation concerning hardness changes of 6xxx aluminum alloys resulting from natural aging.

Furthermore, it can be seen in FIG. 2 that the AA 6061 alloy 6, which additionally has Sn, is subject to clearly less natural aging 3 at room temperature (RT), as documented here, too, by a hardness test according to Brinell HBW 2.5/62.5. As a content of this alloy element, a content of less than 500 atomic ppm has proven to be sufficient. A content of less than 200 atomic ppm is certainly possible.

Excellent results can also occur, however, at a proportion of 10, particularly more than 20, to less than 400, particularly less than 200 atomic ppm in the aluminum alloy. Furthermore, an upper limit of the addition of a combination of the special alloy elements of less than 500, particularly less than 400 atomic ppm in the aluminum alloy can be found.

In general, it should be mentioned that it can be advantageous if the content of the alloy element Sn, Cd, Sb or In or their combination in the aluminum alloy lies at the level of the concentration of empty spaces of the aluminum alloy in its state of solid solution.

Furthermore, it should be mentioned, in general, that natural aging of an aluminum alloy can be understood to be at least partial natural aging, and therefore not exclusively complete natural aging.

Figure 4:
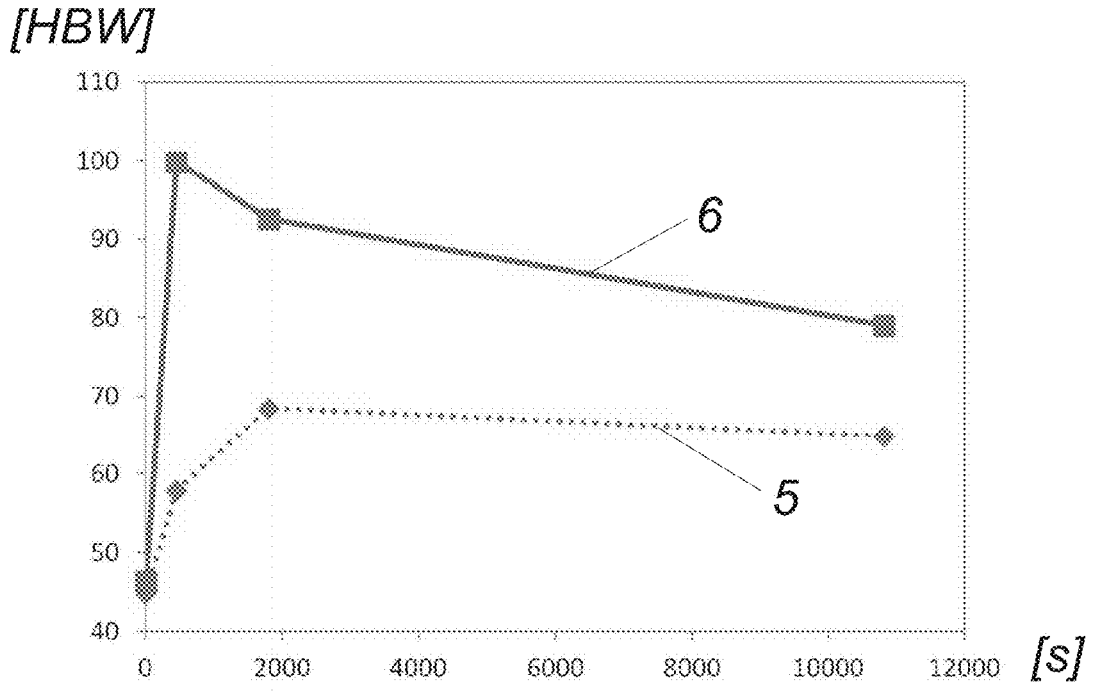
FIG. 4 is a representation concerning hardness changes of 6xxx aluminum alloys in cases of artificial aging at high temperatures.

According to FIG. 4, a further advantage of the addition of the alloy element Sn, Cd, Sb or In or their combination is shown. Here, the change in hardness of an AA 6061 alloy 5 without Sn and an AA 6061 alloy 6 with Sn (470 ppm) is shown, when these alloys are subjected to artificial aging using hot storage at 250 degrees Celsius. The faster reaction time of the alloy 6 with Sn and the higher degree of hardness can be clearly recognized here, where, here, too, in FIG. 4, a hardness test according to Brinell HBW 2.5/62.5 was performed. Reasons for these advantages of the alloy 6 can be stated in that even when using a temperature range of 200 to 300 degrees Celsius, annihilation of the empty spaces by means of disappearance in sinks and/or phase boundaries is clearly reduced. This is because empty spaces have a reduced mobility in the crystal lattice because of their correlation with the alloy element or alloy elements according to the invention, and thereby even higher temperatures can advantageously be used for artificial aging. Significant advantages can result in that the aluminum alloy is subjected to artificial aging immediately after quenching, in other words without natural aging. Here, for example, a faster response of the aluminum alloy to its artificial aging, together with increased hardness values, could be found.

Although only a few embodiments of the present invention have been shown and described, it is to be understood that many changes and modifications may be made thereunto without departing from the spirit and scope of the invention.

What is claimed is:

1. A sheet or plate having:

an aluminum alloy selected from the group consisting of Al—Mg—Si or Al—Si—Mg, wherein the aluminum alloy of the 6xxx series is AA6016, AA6061 or AA6082, wherein the aluminum alloy has precipitates caused by natural aging, wherein the aluminum alloy has at least one alloy element, in addition to its main alloy element or in addition to its main alloy elements, which can be correlated with quenched-in empty spaces of the aluminum alloy, at such a content less than 500 atomic ppm, that the aluminum alloy forms empty spaces essentially not correlated with these precipitates, in order to reduce the negative effect of natural aging of the aluminum alloy on its further artificial aging, by means of mobilization of these non-correlated empty spaces, and wherein the at least one alloy element is selected from the group consisting of Sn, Cd, Sb, and In and combinations thereof.

2. The sheet or plate according to claim 1, wherein the aluminum alloy has empty spaces essentially not correlated with Mg/Si co-clusters.

3. The sheet or plate according to claim 1, wherein the at least one alloy element in the aluminum alloy has a content of 10 to less than 400 atomic ppm.

4. The sheet or plate according to claim 3, wherein the at least one alloy element in the aluminum alloy has a content of more than 20 atomic ppm to less than 200 atomic ppm.

5. The sheet or plate according to claim 1, wherein the alloy elements have a total proportion of less than 500 atomic ppm in the aluminum alloy.

6. The sheet or plate according to claim 1, wherein the at least one alloy element makes up a proportion of less than 200 atomic ppm in the aluminum alloy.

7. The sheet or plate according to claim 1, wherein the alloy elements have a total proportion of less than 400 atomic ppm in the aluminum alloy.

8. A sheet or plate having an aluminum alloy of the 6xxx series, having Sn, Cd, Sb and/or In, individually from 10 atomic ppm to less than 400 atomic ppm, and in total at most 400 atomic ppm, and production-related contaminants, individually at most 0.05 wt.-% and in total at most 0.4 wt.-%, wherein the aluminum alloy of the 6xxx series is AA6016, AA6061 or AA6082.

9. The sheet or plate according to claim 8, wherein the aluminum alloy of the 6xxx series has Sn, Cd, Sb and/or In, individually from 30 atomic ppm to less than 200 atomic ppm.

* * * * *